United States Patent [19]

Seki et al.

[11] Patent Number: 4,758,364

[45] Date of Patent: Jul. 19, 1988

[54] AUTOMATIC TRANSMISSION OIL COMPOSITIONS

[75] Inventors: Haruo Seki, Yokohama; Kensuke Sugiura, Tokyo, both of Japan

[73] Assignee: Nippon Oil Co., Ltd., Tokyo, Japan

[21] Appl. No.: 745,408

[22] Filed: Jun. 14, 1985

[30] Foreign Application Priority Data

Jun. 25, 1984 [JP] Japan ..... 59-130687

[51] Int. Cl.[4] ..... C10M 157/04

[52] U.S. Cl. ..... 252/56 R

[58] Field of Search ..... 252/56 R

[56] References Cited

U.S. PATENT DOCUMENTS

| | | | |
|---|---|---|---|
| 3,304,260 | 2/1967 | Fields | 252/56 R |
| 3,329,613 | 7/1967 | Fischer | 252/56 R |
| 3,340,193 | 9/1967 | Fields | 252/56 R |
| 3,607,749 | 9/1971 | Forbes | 252/56 R |
| 3,835,050 | 9/1974 | Green | 252/56 R |
| 3,897,353 | 7/1975 | Morduchowitz et al. | 252/56 R |
| 4,073,737 | 2/1978 | Elliot | 252/56 R |
| 4,073,738 | 2/1978 | Ladenberger et al. | 252/56 R |
| 4,080,304 | 3/1978 | Smith | 252/56 R |
| 4,370,247 | 1/1983 | Ostyn | 252/56 R |
| 4,533,482 | 8/1985 | Bollinger | 252/56 R |
| 4,546,137 | 10/1985 | Rossi et al. | 252/56 R |

*Primary Examiner*—William R. Dixon, Jr
*Assistant Examiner*—Jerry D. Johnson
*Attorney, Agent, or Firm*—Bucknam & Archer

[57] ABSTRACT

A lubricating oil composition suitable for use in automotive transmissions of an automatic type is disclosed. The oil, mineral or synthetic, is combined with specified amounts of $C_2$–$C_{10}$ monoolefin polymers and methacrylic acid ester copolymers of $C_1$–$C_{18}$ saturated aliphatic monovalent alcohols, whereby viscosity/temperature characteristics and shear stability in particular are greatly improved.

3 Claims, No Drawings

AUTOMATIC TRANSMISSION OIL COMPOSITIONS

BACKGROUND OF THE INVENTION

1. Field of the Invention

This invention relates to automatic transmission oil compositions.

2. Prior Art

An automatic transmission in an automobile is a mechanism designed to make automatic setting of torque ratios according to the speed of travel and the amount of load. This mechanism comprises a torque converter, a multiplate clutch/planetary gear and an oil pressure regulator that are all lubricated by a common transmission oil. The oil pressure regulator detects delicate changes in the car speed and load, thereby controlling the overall operation of the transmission. The oil in the torque converter and clutch/gear sections is subjected to severe shear which tends to break off the molecules of the high molecular viscosity index improver that is present in the oil, resulting in reduced oil viscosity. This must be suppressed to prevent lower lubrication and reduced oil pressure leading to unstable operation of the transmission system. Subjecting the transmission oil to severer shear is anticipated by the introduction of a continuously variable transmission (CVT) which outdates the conventional automatic transmissions. A keen demand is therefore called for an improved lubricating oil which has the requirements of all types of automative transmission and which is in particular capable of holding a viscosity loss below 10% with respect to fresh oil under varying operating conditions.

Ordinarily, transmission oils are used commonly throughout all seasons from cold to hot environment and therefore should desirably be least susceptible to changes in viscosity with temperature and less viscous at lower temperature. Too low viscosity with elevated temperature would fail to build sufficient oil pressure, and conversely too high viscosity with low temperature would lose oil fluidity. With this in view, the transmission oil should normally have a viscosity of above 7 cSt at 100° C. and below 50,000 cp at −40° C.

Automatic transmission oil compositions in conventional use typically comprise mineral oils or synthetic oils blended with a viscosity index improver such as methacrylic acid ester copolymers and styrene/ester copolymers. While these transmission oils are satisfactory in viscosity-temperature characteristics and low temperature fluidity, they are not totally satisfactory with respect to viscosity against mechanical shear. This problem could be coped with, as appears obvious to one skilled in the art, by reducing the average molecular weight of the aforesaid viscosity index improvers. However, such approach is impractical where higher shear stability is required.

SUMMARY OF THE INVENTION

It is an object of the present invention to provide an improved automatic transmission oil composition which has excellent viscosity-temperature characteristics and sufficient low temperature fluidity and which in particular exhibits high shear stability.

This object is achieved by the provision of an automatic transmission oil composition which comprises a lubricating base oil having a viscosity of 1.5–5.0 cSt at 100° C., (I) a homopolymer or copolymer of mono-olefins having a carbon number of 2–10 and an average molecular weight of 1,000–10,000, and (II) one or more copolymers having an average molecular weight of 5,000–50,000 and selected from the group of copolymers (a) of two or more methacrylic acid esters of the formula

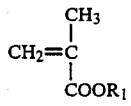

[A]

where $R_1$ is an alkyl group of 1–18 carbon atoms, and the group of copolymers (b) of one or more methacrylic acid esters of formula [A] and one or more nitrogen-containing monomers of the formula

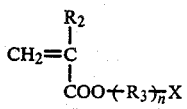

[B]

or

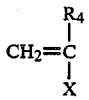

[B']

where $R_2$ and $R_4$ are a hydrogen atom or a methyl group, $R_3$ is an alkylene group of 2–18 carbon atoms, n is an integer of 0 or 1, and X is amine moieties of heterocyclic moieties containing 1–2 nitrogen atoms and 0–2 oxygen atoms, said homopolymer or copolymer [I] and said copolymers [II] being added in amounts of 1–15 weight % and 1–5 weight %, respectively, based on the total composition.

It has now thus been found that the desired properties of the transmission oil according to the invention are brought out by the co-presence of specific olefin polymers or copolymers of relatively low molecular weight and 2–10 carbon atoms and specific methacrylic acid ester copolymers derived from saturated aliphatic monovalent alcohols of relatively low molecular weight and 1–18 carbon atoms, or copolymers of methacrylic acid esters and nitrogen-containing monomers.

DESCRIPTION OF THE PREFERRED EMBODIMENTS

The term "lubricating base oil" as used herein includes both mineral and synthetic oils having a viscosity in the range of 1.5–5.0 cSt at 100° C. Either oil may be used alone, or mixtures of two or more of these oils may also be used in which case the viscosity at 100° C. is 1.5–50 cSt. Typical examples of such mineral base oil include Pale 70, SAE 10, SAE 20, SAE 30, SAE 50, bright stock and cylinder stock, and 1-decene oligomers (viscosity 2.0–50 cSt at 10° C.), diesters (di-2-ethylhexylsebacate, dioctyladipate, dioctyldodecanoate and the like), polyol esters (pentaerythritol tetraoleate, trimethylolpropane tripelargonate and the like).

Component (I) according to the invention is a homopolymer or copolymer resulting from the polymerization of $C_2$–$C_{10}$ olefins which include ethylene, propylene, 1-butene, isobutylene, 2-butene, 1-octene and 1-decene. Preferred polymers are polypropylene, polyisobutylene and 1-butene/isobutylene copolymer. Suitable average molecular weights are 1,000–10,000, but the range of 2,000–3,000 is preferred.

Component (II) according to the invention is one or more copolymers having an average molecular weight of 5,000–50,000 selected from the group of the following Copolymer (a) and Copolymer (b).

Compound (a) is two or more copolymers of methacrylic acid esters of the formula

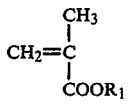

[A]

where $R_1$ is an alkyl group of 1–18 carbon atoms.

Examples of Copolymer (a) are methylmethacrylate, ethylmethacrylate, propylmethacrylate, butylmethacrylate, pentylmethacrylate, hexylmethacrylate, heptylmethacrylate, octylmethacrylate, nonylmethacrylate, decylmethacrylate, undecylmethacrylate, dodecylmethacrylate, tridecylmethacrylate, tetradecylmethacrylate, pentadecylmethacrylate, hexadecylmethacrylate, heptadecylmethacrylate and octadecylmethacrylate.

The amount of Component (I) to be added to the lubricating base oil is 1–15 weight percent and preferably 5–12 weight percent based on the total composition.

Copolymer (b) is a copolymer of one or more methacrylic acid esters of formula [A] and one or more nitrogen-containing monomers of the formula

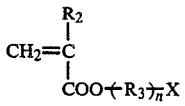

[B]

or

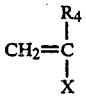

[B']

where $R_2$ and $R_4$ are a hydrogen atom or a methyl group, $R_3$ is an alkylene group of 2–18 carbon atoms, n is an integer of 0 or 1, and X is amine moieties or heterocyclic moieties containing 1–2 nitrogen atoms and 0–2 oxygen atoms.

Alkylene group $R_3$ includes those of ethylene, propylene, butylene, hexylene, octylene, decylene, dodecylene, tetradecylene, hexadecylene and octadecylene.

Amine or heterocylic moieties X include groups of dimethylamino, diethylamino, dipropylamino, dibutylamino and further anilino group ( 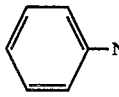 ), toluidino group ( 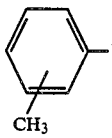 ), -continued xylidino group ( 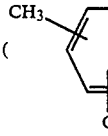 ), acetylamino group ($CH_3CONH$—), benzoylamino group ( 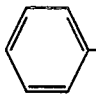 ), morpholino group ( 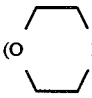 ), pyrrolyl group ( 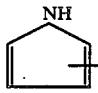 ), pyrrolino group ( 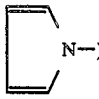 ), pyridyl group ( 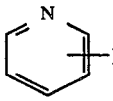 ), methylpyridyl group ( 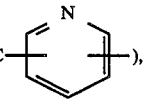 ), pyrrolidinyl group ( 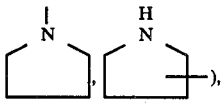 ), piperidinyl group ( 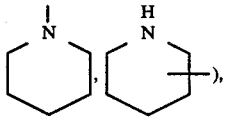 ), quinolyl group ( 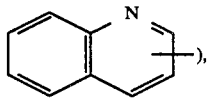 ), pyrrolidonyl group ( 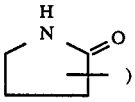 )

pyrrolidono group ( 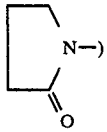 )

-continued imidazolino group ( 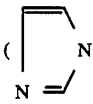 ), pyrazino group ( 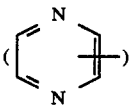 )

and the like.

Nitrogen-containing monomers of formula [B] or [B'] include morpholinoethylmethacrylate,

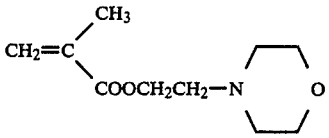

diethylaminoethylmethacrylate,

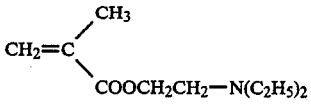

2-methyl-5-vinylpyridine,

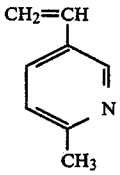

N—vinylpyrrolidone 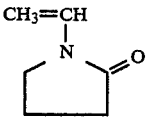

and mixtures thereof.

Copolymer (b) is obtained from the copolymerization of methacrylic acid esters of formula [A] and nitrogen-containing monomers of formula [B] or [B']. The molar ratio of methacrylic acid ester to nitrogen-containing monomer is optional, normally about 80:20–95:5.

The average molecular weight of Component (II) is suitably in the range of 5,000–50,000 and preferably in the range of 10,000–30,000. The amount of Component (II) to be added to the lubricating base oil is 1–5 weight %, preferably 2–3 weight % based on the total composition.

There may be used other additives such as metallic cleaning agents such as sulfonates, phenates, carboxylates, salicylates and the like derived from alkali earth metals; ash-free dispersants such as alkenyl succinimides, alkyl benzylamines and the like; antioxidants such as alkyl or aryl zinc dithiophosphates, hindered phenols, aromatic amines and the like; extreme pressure agents such as sulfate olefins, sulfate esters, phosphate esters, phosphite esters and the like; oiliness improvers/friction reducers such as aliphatic acids, their salts and esters, higher alcohols, acid phosphate esters, amines and the like; rust preventives; and defoamers.

The invention will be further described by way of the following examples.

EXAMPLE 1

| Oil Composition | wt % |
|---|---|
| Base oil: refined mineral oil (3 cSt @ 100° C.) | 82.0 |
| Component (I): polybutene (average molecular weight 2,500) | 8.0 |
| Component (II): methacrylic acid ester copolymer of $C_1$–$C_{18}$ saturated aliphatic monovalent alcohol (average molecular weight 20,000) | 3.0 |
| Additives: Package of cleaning dispersant, antioxidant and friction reducer | 7.0 |

EXAMPLE 2

| Oil Composition | wt % |
|---|---|
| Base oil: refined mineral oil (3.5 cSt @ 100° C.) | 84.0 |
| Component (I): polyisobutylene (average molecular weight 8,000) | 6.0 |
| Component (II): methacrylic acid ester copolymer of $C_1$–$C_{18}$ saturated aliphatic monovalent alcohol (average molecular weight 20,000) | 3.0 |
| Additives: Package of cleaning dispersant, antioxidant and friction reducer | 7.0 |

EXAMPLE 3

| Oil Composition | wt % |
|---|---|
| Base oil: refined mineral oil (3 cSt @ 100° C.) | 81.0 |
| Component (I) polybutene (average molecular weight 2,300) | 6.0 |
| Component (II): methacrylic acid ester copolymer of $C_1$–$C_{18}$ saturated aliphatic monovalent alcohol (average molecular weight 10,000) | 4.0 |
| Additives: Package of cleaning dispersant, antioxidant and friction reducer | 7.0 |

EXAMPLE 4

| Oil Composition | wt % |
|---|---|
| Base oil: refined mineral oil (3 cSt @ 100° C.) | 82.8 |
| Component (I): polybutene (average molecular weight 2,300) | 8.0 |
| Component (II): copolymer of methacrylic acid ester of $C_1$–$C_{18}$ saturated aliphatic monovalent alcohol and N—vinylpyrrolidone (average molecular weight 30,000; N—vinylpyrrolidone contents about 10 mol %) | 2.2 |
| Additives: | 7.0 |

-continued

| Oil Composition | wt % |
|---|---|
| Package of cleaning dispersant, antioxidant and friction reducer | |

EXAMPLE 5

| Oil Composition | wt % |
|---|---|
| Base oil: refined mineral oil (3 cSt @ 100° C.) | 82.0 |
| Component (I): polybutene (average molecular weight 2,500) | 8.0 |
| Component (II): copolymer of methacrylic acid ester of $C_1$–$C_{18}$ saturated aliphatic monovalent alcohol and morpholinoethylmethacrylate (average molecular weight 20,000; morpholinoethylmethacrylate contents about 5 mol %) | 3.0 |
| Additives: Package of cleaning dispersant, antioxidant and friction reducer | 7.0 |

COMPARATIVE EXAMPLE 1

| Oil Composition | wt % |
|---|---|
| Base oil: refined mineral oil (4.3 cSt @ 100° C.) | 83.0 |
| Component (II): methacrylic acid ester copolymer of $C_1$–$C_{18}$ saturated aliphatic monovalent alcohol (average molecular weight 20,000) | 10.0 |
| Additives: Package of cleaning dispersant, antioxidant and friction reducer | 7.0 |

COMPARATIVE EXAMPLE 2

| Oil Composition | wt % |
|---|---|
| Base oil: refined mineral oil (4.3 cSt @ 100° C.) | 80.0 |
| Component (II): methacrylic acid ester copolymer of $C_1$–$C_{18}$ saturated aliphatic monovalent alcohol (average molecular weight 10,000) | 13.0 |
| Additives: Package of cleaning dispersant, antioxidant and friction reducer | 7.0 |

COMPARATIVE EXAMPLE 3

| Oil Composition | wt % |
|---|---|
| Base oil: refined mineral oil (3 cSt @ 100° C.) | 80.7 |
| Component (I): polybutene (average molecular weight 2,500) | 12.0 |
| Component (II): methacrylic acid ester copolymer of $C_1$–$C_{18}$ saturated aliphatic monovalent alcohol (average molecular weight 10,000) | 0.3* |
| Additives: Package of cleaning dispersant, antioxidant and friction reducer | 7.0 |

*used as pour point reducer.

COMPARATIVE EXAMPLE 4

| Oil Composition | wt % |
|---|---|
| Base oil: refined mineral oil (3.5 cSt @ 100° C.) | 82.7 |
| Component (I): polyisobutylene (average molecular weight 8,000) | 10.0 |
| Component (II): methacrylic acid ester copolymer of $C_1$–$C_{18}$ saturated aliphatic monovalent alcohol (average molecular weight 20,000) | 0.3* |
| Additives: Package of cleaning dispersant, antioxidant and friction reducer | 7.0 |

*used as pour point reducer.

COMPARATIVE EXAMPLE 5

| Oil Composition | wt % |
|---|---|
| Base oil: refined mineral oil (3 cSt @ 100° C.) | 85.0 |
| Component (II): methacrylic acid ester copolymer of $C_1$–$C_{18}$ saturated aliphatic monovalent alcohol (average molecular weight 20,000) | 0.3 |
| Polyisobutylene (average molecular weight 30,000) | 5.0 |
| Additives: Package of cleaning dispersant, antioxidant and friction reducer | 7.0 |

*used as pour point reducer.

Each of the transmission oil compositions provided in the above Examples and Comparative Examples was tested for viscosity and shear stability with the results shown in Table 1.

TABLE 1

| | Viscosity, cSt @ 100° C. | Viscosity, cP @ −40° C. | Shear Stability (viscosity drop %) Sonic radiation |
|---|---|---|---|
| Example | | | |
| 1 | 7.5 | 42,000 | 6 |
| 2 | 7.5 | 35,000 | 9 |
| 3 | 7.5 | 44,000 | 5 |
| 4 | 7.5 | 42,000 | 9 |
| 5 | 7.5 | 41,000 | 6 |
| Comparative Example | | | |
| 1 | 7.5 | 35,000 | 18 |
| 2 | 7.5 | 75,000 | 8 |
| 3 | 7.5 | >100,000 | 2 |
| 4 | 7.5 | >100,000 | 8 |
| 5 | 7.5 | 38,000 | 20 |

Viscosity at 100° C.

Measurement was made in accordance with JIS K2283 (Standard Method for Dynamic Viscosity Measurement), using Cannon-Fenske viscosimeter. Above 7.0 cSt is desirable.

Viscosity at −40° C.

Brookfield viscosimeter was used to measure this viscosity. Below 50,000 cP is desirable.

Shear Stability

ASTM D2603-76 (Standard Test Method for Sonic Shear Stability of Polymer-Containing Oils) was followed with sonic radiation of 10 KHz for one hour. Shear stability is obtained from the following equation:

$$\text{Shear Stability (\%)} = \frac{\text{viscosity of fresh oil} - \text{viscosity after sonic radiation}}{\text{fresh oil viscosity}} \times 100$$

It is to be noted that all of Examples 1–5 embodying the invention are satisfactory in respect of both low temperature viscosity and shear stability.

Whereas, Comparative Example 1 in which Component (I) of the invention is omitted fails to give sufficient shear stability.

Comparative Example 2 also omitting Component (I) but using polymethacrylate (Component II) of lower molecular weight than that of Comparative Example 1 shows improved shear stability but conversely insufficient low temperature viscosity.

Comparative Examples 3 and 4 using small amounts of Component (II) as pour-point reducer are not satisfactory for low temperature viscosity.

Comparative Example 5 using a Component (I) of larger molecular weight than specified herein fails to give acceptable shear stability.

What is claimed is:

1. An automatic transmission oil composition comprising a lubricating base oil having a viscosity of 1.5–5.0 cSt at 100° C., (I) a polymer which is a member selected from the group consisting of polypropylene, polyisobutylene and a copolymer of 1-butene and isobutylene, said polymer having a molecular weight of 2000–3000 and (II), at least one copolymer having an average molecular weight of 10,000–30,000 which is a member selected from the group consisting of copolymers (a) of two or more methacrylic acid esters of the formula

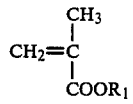

[A]

wherein $R_1$ is alkyl of 1–18 carbon atoms, and copolymers (b) which is at least one methacrylic acid ester of formula [A] and one or more nitrogen-containing monomers of the formula

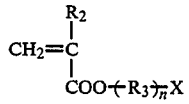

[B]

or

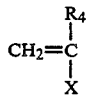

[B']

wherein $R_2$ and $R_4$ are hydrogen or methyl, $R_3$ is an alkylene of 2–18 carbon atoms, n is an integer of 0 or 1, and X is an amine moiety or a heterocyclic moiety containing 1–2 nitrogen atoms and 0–2 oxygen atoms, said homopolymer or copolymer [I] being in the amount of 5–12% and said copolymer [II] being in the amount of 1–5% by weight respectively, based on the total composition.

2. An automatic transmission oil composition according to claim 1 wherein said lubricating base oil is a mineral or synthetic oil having a viscosity in the range of 1.5–5.0 cSt at 100° C.

3. An automatic transmission oil composition according to claim 1 wherein said copolymer (a) is a member selected from the group consisting of methylmethacrylate, ethylmethacrylate, propylmethacrylate, butylmethacrylate, pentylmethacrylate, hexylmethacrylate, heptylmethacrylate, octylmethacrylate, nonylmethacrylate, decylmethacrylate, undecylmethacrylate, dodecylmethacrylate, tridecylmethacrylate, tetradecylmethacrylate, pentadecylmethacrylate, hexadecylmethacrylate, heptadecylmethacrylate and octadecylmethacrylate.

* * * * *